US012611572B2

(12) United States Patent
Zhang et al.

(10) Patent No.: US 12,611,572 B2
(45) Date of Patent: Apr. 28, 2026

(54) MULTIFUNCTIONAL HAND GRIP EXERCISER

(71) Applicant: NINGBO HAOLEI INTELLIGENT TECHNOLOGY CO., LTD., Yuyao (CN)

(72) Inventors: Xiaojuan Zhang, Yuyao (CN); Min Li, Yuyao (CN); Shenghui Zhang, Yuyao (CN); Kaikai Fang, Yuyao (CN)

(73) Assignee: NINGBO HAOLEI INTELLIGENT TECHNOLOGY CO., LTD., Yuyao (CN)

( * ) Notice: Subject to any disclaimer, the term of this patent is extended or adjusted under 35 U.S.C. 154(b) by 67 days.

(21) Appl. No.: 18/829,444

(22) Filed: Sep. 10, 2024

(65) Prior Publication Data

US 2025/0001249 A1 Jan. 2, 2025

Related U.S. Application Data

(63) Continuation of application No. PCT/CN2023/095830, filed on May 23, 2023.

(30) Foreign Application Priority Data

Dec. 21, 2022 (CN) ..... 202223449732.8

(51) Int. Cl.
*A63B 23/16* (2006.01)
*A63B 21/00* (2006.01)
(Continued)

(52) U.S. Cl.
CPC ..... *A63B 23/16* (2013.01); *A63B 21/00069* (2013.01); *A63B 21/023* (2013.01);
(Continued)

(58) Field of Classification Search
CPC . A63B 23/16; A63B 21/00069; A63B 21/023; A63B 21/0421; A63B 21/4035;
(Continued)

(56) References Cited

U.S. PATENT DOCUMENTS 1,229,658 A * 6/1917 Sandow ..... A63B 21/0726 482/50
3,738,651 A * 6/1973 Norman ..... A63B 23/16 73/379.03
(Continued)

FOREIGN PATENT DOCUMENTS

CN 205814970 U 12/2016
CN 106924939 A 7/2017
(Continued)

OTHER PUBLICATIONS

International Search Report issued in corresponding International application No. PCT/CN2023/095830, mailed Sep. 19, 2023.
(Continued)

*Primary Examiner* — Andrew S Lo
(74) *Attorney, Agent, or Firm* — HOWARD M COHN and Associates, LLC

(57) ABSTRACT

A multifunctional hand grip exerciser is provided, including a main body, a lever, and a finger pressing assembly. The main body includes a handle portion, an elastic assembly is disposed in the main body, mounting cavities are defined on the handle portion, and outer ends of the mounting cavities respectively penetrate through a surface of the handle portion. The lever is rotatably connected to the main body, a driving end of the lever is connected to the elastic assembly, and the elastic assembly is configured to provide resistance for the lever to rotate. The finger pressing assembly includes pressing heads for pressing, the pressing heads are disposed corresponding to the mounting cavities, the pressing heads are respectively and slidably disposed in the mounting
(Continued)

cavities, and free ends of the pressing heads are capable of respectively extending out of or retracting into the mounting cavities.

11 Claims, 8 Drawing Sheets

(51) Int. Cl.
*A63B 21/02* (2006.01)
*A63B 21/04* (2006.01)
*A63B 71/06* (2006.01)

(52) U.S. Cl.
CPC ..... *A63B 21/0421* (2013.01); *A63B 21/4035* (2015.10); *A63B 71/0622* (2013.01); *A63B 2220/17* (2013.01)

(58) Field of Classification Search
CPC . A63B 71/0622; A63B 2220/17; A63B 21/05; A63B 71/06
See application file for complete search history.

(56) References Cited

U.S. PATENT DOCUMENTS 4,678,181 A * 7/1987 Ditsch ..... A63B 23/16 482/47
5,147,256 A * 9/1992 Silagy ..... A63B 23/16 482/49
5,431,611 A * 7/1995 Silagy ..... A63B 23/16 482/122
5,472,400 A * 12/1995 Royer ..... A63B 23/16 482/141
D405,134 S * 2/1999 Hug ..... D21/684
D418,560 S * 1/2000 Hug ..... D21/692
D419,210 S * 1/2000 Hug ..... D21/684
7,794,369 B1 * 9/2010 Rivera, III ..... A63B 23/16 482/81
7,824,311 B1 * 11/2010 Hsu ..... A63B 23/16 482/126
7,967,732 B2 * 6/2011 D'Addario ..... A63B 21/023 482/44
9,114,280 B2 * 8/2015 Silagy ..... A63B 23/16
9,597,547 B1 * 3/2017 Goldberg ..... A63B 21/023
9,700,758 B1 * 7/2017 Goldberg ..... A63B 21/4035
D831,759 S * 10/2018 Cerreta ..... D21/684
11,400,341 B2 * 8/2022 Van Willigen ..... A63B 21/023
D967,913 S * 10/2022 Shang ..... D21/684
11,504,579 B2 * 11/2022 D'Addario ..... A63B 21/023
12,364,901 B1 * 7/2025 Gao ..... A63B 23/03508
2008/0103026 A1 * 5/2008 An ..... A63B 21/023 482/49
2009/0318269 A1 * 12/2009 D'Addario ..... A63B 21/023 482/49
2013/0012358 A1 * 1/2013 Lynn ..... A63B 23/16 220/737
2013/0196825 A1 * 8/2013 Silagy ..... A63B 21/023 482/49
2015/0190675 A1 * 7/2015 Silagy ..... A63B 21/05 482/49
2019/0255383 A1 * 8/2019 An ..... A63B 21/00072
2019/0366145 A1 * 12/2019 Reda ..... A63B 1/00
2021/0162259 A1 * 6/2021 D'Addario ..... A63B 21/05

FOREIGN PATENT DOCUMENTS

CN 209771232 U 12/2019
CN 210543157 U 5/2020
CN 210728580 U 6/2020
CN 215461713 U 1/2022
JP 3159584 U 5/2010
KR 20020033005 A 5/2002
KR 20110009416 U 10/2011
TW M299007 U 10/2006

OTHER PUBLICATIONS

Written Opinion of the International Search Authority in corresponding International application No. PCT/CN2023/095830, mailed Sep. 19, 2023.

* cited by examiner

MULTIFUNCTIONAL HAND GRIP EXERCISER

TECHNICAL FIELD

The present disclosure relates to a technical field of fitness equipment, and in particular to a multifunctional hand grip exerciser.

BACKGROUND

Hand grip exercisers are one kind of fitness equipment for training hands and strengthening forearm muscles, which are also known as arm grips, hand grip strengtheners, dynamometers, etc., the hand grip exercises are small in size, light in weight, and are convenient in carriage, thereby not limiting by spaces during training and being deeply favored by users. The hand grip exercisers are capable of reliving fatigue, building muscle strength, and improving blood circulation, moreover, regularly training using the hand grip exercisers enables better blood circulation of joints, thereby significantly preventing inflammation and aiding in muscle recovery.

Currently, the hand grip exercisers each generally includes two handles, free ends of the two handles are connected through a spiral elastic component, and the spiral elastic component drives the two handles to returned to original positions after being compressed. For example, Chinese patent having a publication number of CN215461713U and a title of hand grip exerciser discloses two grip exerciser handles connected through an elastic body. For another example, Chinese patent having a publication number of CN210728580U and a title of a hand grip exerciser discloses two grip exerciser handles connected through a spiral elastic body.

To provide users with a more scientific and staged approach to training grip strength and arm strength, current hand grip exercisers are additionally provided with counting functions and grip strength adjusting functions. For example, Chinese patent having a publication number of CN205814970U and a title of a countable and adjustable first spring hand grip exerciser including a first handle and a second handle, the first handle and the second handle are pivotally connected by a rivet, an adjusting first spring is disposed between the first handle and the second handle, an adjusting screw and an adjusting nut are disposed on the second handle, and a sliding slot is defined at an upper end of the second handle A first end of the adjusting first spring is fixedly connected to an upper portion of the first handle, while a second end of the adjusting first spring passes through the sliding slot and is pivotally connected to an upper portion of the adjusting nut, a position of the adjusting first spring within the sliding slot is adjusted through rotating the adjusting nut, thereby changing tension of the adjusting first spring and enabling grip strength adjustment. Moreover, a counting sensor and a display screen are disposed on the first handle of the countable and adjustable first spring hand grip exerciser for recording the number of times that the users grip, so as to achieve a purpose of scientific exercise.

Based on above, the users may only perform grip strength training with their fingers together during exercising, in this way, only hands are trained but an individual finger strength training cannot be achieved. Especially, after a period of grip training for the hands, the hands may become fatigued or painful, and the users need to perform relaxation or recovery exercises on their fingers to alleviate fatigue or pain. Obviously, current hand grip exercisers cannot not meet such finger-specific training requirements of the users.

SUMMARY

A technical problem to be solved by the present disclosure is to provide a multifunctional hand grip exerciser to overcome defects in the prior art, the multifunctional hand grip exerciser is not only capable of applying to hand grip training, but also capable of providing finger strength training, especially for fingers to perform relaxation or recovery training.

A technical solution of the present disclosure is to provide the multifunctional hand grip exerciser having following structures.

The multifunctional hand grip exerciser includes a main body, a lever, and a finger pressing assembly. The main body includes a handle portion, an elastic assembly is disposed in the main body, mounting cavities are defined on the handle portion, and outer ends of the mounting cavities respectively penetrate through a surface of the handle portion. The lever is rotatably connected to the main body, a driving end of the lever is connected to the elastic assembly, and the elastic assembly is configured to provide resistance for the lever to rotate. The finger pressing assembly includes pressing heads for pressing, the pressing heads are disposed corresponding to the mounting cavities, the pressing heads are respectively and slidably disposed in the mounting cavities, and free ends of the pressing heads are capable of respectively extending out of or retracting into the mounting cavities. Elastic components are respectively disposed in the mounting cavities and respectively abut against the pressing heads, the elastic components enable the free ends of the pressing heads to keep in a first tendency to extend out of the mounting cavities.

Furthermore, the multifunctional hand grip exerciser includes a locking assembly, the locking assembly is connected to the handle portion and is configured to enable the pressing heads to be in a locked state or an unlocked state. When the pressing heads are in the locked state, the free ends of the pressing heads retract and are kept in the mounting cavities. When the pressing heads are in the unlocked state, the free ends of the pressing heads extend out of the mounting cavities.

Furthermore, the pressing heads are sequentially disposed in a length direction of the handle portion, each of the pressing heads includes a limiting block connected to a first outer side wall of an inner end thereof, and each limiting block horizontally extends outward. A locking plate is slidably disposed in the handle portion along the length direction of the handle portion, the locking plate includes locking grooves, each of the locking grooves is configured to clamp a corresponding limiting block when the pressing heads retract into the mounting cavities. A push button is connected to locking plate and is exposed out of the surface of the handle portion.

Furthermore, a holder is further disposed in the handle portion, the mounting cavities are defined on the holder along a length direction of the holder, the holder includes a sliding groove at one side thereof, the sliding groove is communicated with the mounting cavities, and the locking plate is slidably disposed in the sliding groove. At least one positioning protrusion is disposed on an inner side wall of the holder, the at least one positioning protrusion extends into the sliding groove, at least two positioning grooves are defined on an outer side wall of the locking plate, the at least two positioning grooves are elastically clamped with the at least one positioning protrusion, when the locking plate slides along a length direction of the sliding groove, the at least one positioning protrusion is switched between the at least two positioning grooves, so as to lock or unlock the locking plate.

Furthermore, guiding grooves are defined on inner walls of each of the mounting cavities, each guiding grooves extend along a length direction of a corresponding one of the mounting cavities, each of the pressing heads further includes guiding blocks respectively disposed on a second outer side wall and a third outer wall of the inner end thereof, and the guiding blocks are respectively in clearance fit with the guiding grooves.

Furthermore, the multifunctional hand grip exerciser further includes a counting device, the counting device includes a counting device main body disposed in the handle portion. The counting device main body includes a display disposed on the handle portion, the display is configured to display a count, a counting head is connected to a side wall of the handle portion close to the lever, and the counting device main body counts once when the lever is close to or in contact with the counting head.

Furthermore, the elastic assembly includes a guiding rod, the guiding rod is disposed in the main body and is rotatable in a circumferential direction, a first spring and a sliding component are slidably sleeved on the guiding rod. The sliding component is connected to the driving end of the lever, the lever drives the sliding component to slide on the guiding rod when rotating with respect to the handle portion. An adjusting block is screwed with the guiding rod, and a circumferential rotation of the adjusting block is limited by an inner wall of the main body. A first end of the first spring abuts against the sliding component, a second end of the first spring abuts against the adjusting block. An adjusting base is connected to an outer end of the guiding rod, the adjusting base rotates to drive the guiding rod to synchronously rotate, so that the adjusting block moves in a length direction of the guiding rod to adjust a first elastic force of the first spring.

Furthermore, a locking mechanism is disposed on the main body, the locking mechanism is configured to lock the lever when the lever is pressed down to keep the lever in a pressed-down state.

Furthermore, a knob groove is defined on the main body, a knob is rotatably disposed in the knob groove, and the knob moves in an axial direction when rotating. A limiting plate is disposed in the main body and is connected to an inner end of the knob, a limiting groove for matching and clamping with the limiting plate is defined on an outer side wall of the driving end of the lever. A second spring is disposed in the knob groove, a first end of the second spring abuts against an inner bottom wall of the knob groove, a second end of the second spring abuts against the knob, the second spring is configured to apply a second elastic force to the knob to enable the limiting plate to always have a second tendency to move away from the limiting groove. When the lever is pressed down, the knob is rotated to clamp the limiting plate with the limiting groove, and the lever is locked to keep in the pressed-down state.

Furthermore, two insertion holes are circumferentially defined on an inner bottom wall of the knob groove, the knob includes two inserting blocks, the two inserting blocks are in clearance fit with the insertion holes, limiting walls are connected to inner ends of the two inserting blocks, the limiting walls extend in a circumferential direction of the knob groove, the limiting walls abut against an outer bottom wall of the knob groove to limit the knob in the knob groove. Accommodating grooves are recessed inward from the outer bottom wall of the knob groove corresponding to the limiting walls, arc-shaped protrusions respectively protrude outward from the limiting walls, the arc-shaped protrusions are respectively fit in the accommodating grooves and are movable. When the lever is pressed down and the knob is rotated, the arc-shaped protrusions on the limiting walls are respectively separated from the accommodating grooves to enable the limiting plate to move in a direction close to the limiting groove and clamp in the limiting groove.

Based on above and compared with the prior art, the present disclosure provides the multifunctional hand grip exerciser having following advantages.

First, the multifunctional hand grip exerciser applies a rotational resistance to the lever through the elastic assembly to achieve a purpose of grip strength training or forearm muscle strength training, and the adjusting base is rotated to adjust the first elastic force of the first spring of the elastic assembly, so as to change a grip force required for operating the multifunctional hand grip exerciser, so as to meet requirements of different users or meet requirements for the grip force required for operating the multifunctional hand grip exerciser at different training stages. Moreover, the finger pressing assembly is disposed on the handle portion of the main body, and the pressing heads of the finger pressing assembly are provided for the users to perform finger strength training, finger relaxation training, or finger recovery training, so as to meet the requirements of different users, especially, after a period of grip training for hands, the hands may become fatigued or painful, and the users may use the finger pressing assembly to perform relaxation or recovery exercises on their fingers to alleviate fatigue or pain, the multifunctional hand grip exerciser is diversified in functions and is capable of meeting the requirements of different users.

Second, when the users train the hands and strengthen forearm muscles using the lever and the handle portion, the pressing heads of the finger pressing assembly are retracted into the handle portion and are locked through the locking assembly, so that the finger pressing assembly on the handle portion does not affect the grip strength training or forearm muscle strength training; when the users train the fingers using the finger pressing assembly, the lever is also capable of being locked by the locking mechanism on the main body, so that the lever does not affect use of the finger pressing assembly. Therefore, the multifunctional hand grip exerciser is very convenient in use, the finger pressing assembly and the lever do not affect each other, thereby providing good user experience.

Third, when the pressing heads are locked through the locking assembly, the pressing heads are respectively retracted into the mounting cavities against elastic forces of the elastic components, and then the locking plate is moved by pushing the push button, so that each of the locking grooves of the locking plate is clamped with the corresponding limiting block at a corresponding inner end of a corresponding one of the pressing heads, so that the pressing heads are respectively locked in the mounting cavities; on the contrary, when the push button is pushed in an opposite direction to move the locking plate in the opposite direction, each of the locking grooves of the lock plate is separated from the corresponding limiting block at the corresponding inner end of the corresponding one of the pressing heads, the free ends of the pressing heads automatically extend out of the mounting cavities under the elastic forces of the elastic components, and at this time, the users may perform finger pressing training through the pressing heads.

In addition, the multifunctional hand grip exerciser is provided with the counting device for conveniently counting, which is beneficial for the users to perform scientific training using the multifunctional hand grip exerciser.

Figure 1:
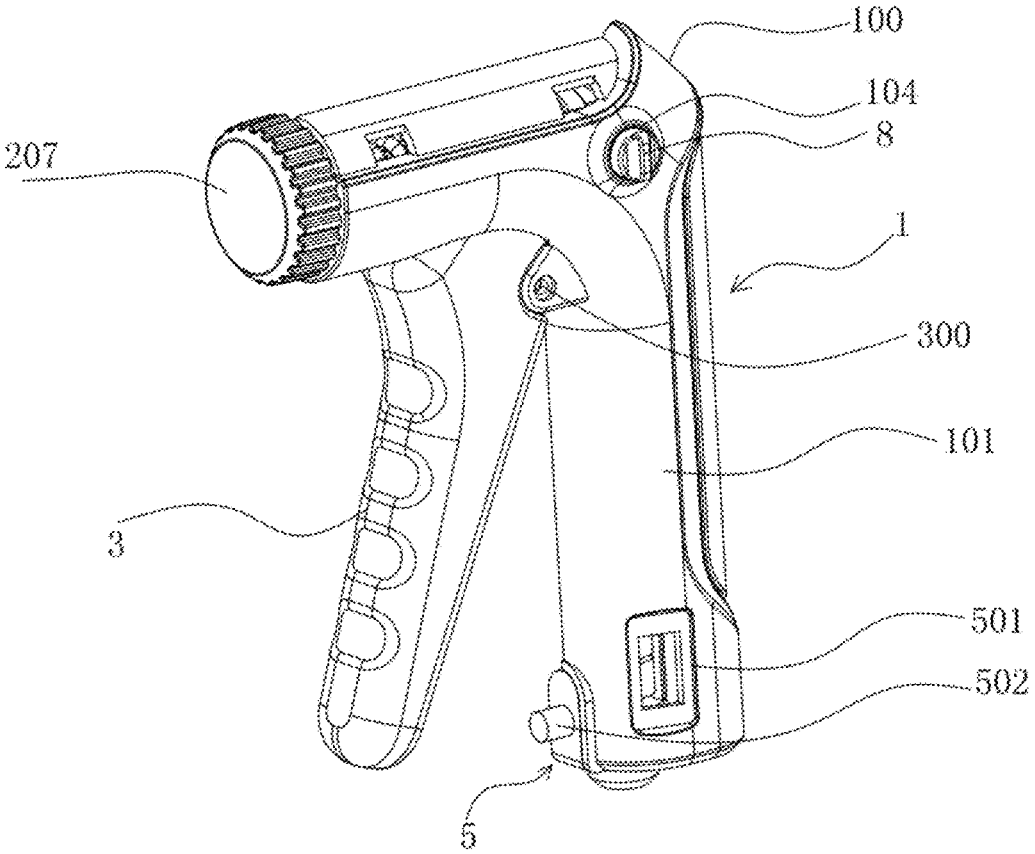
FIG. 1 is a structural schematic diagram of a multifunctional hand grip exerciser of the present disclosure.

Reference numerals in the drawings: 1. main body; 100. outer housing; 101. handle portion; 102. mounting cavity; 103. push button hole; 104. knob groove; 105. insertion hole; 106. accommodating groove; 107; rectangular groove; 2. elastic assembly; 200. guiding rod; 201. rotating disc; 202. sliding component; 203. connecting shaft; 204. first spring; 205. adjusting block; 206. radial protrusion; 207. adjusting base; 3. lever; 300. rotating shaft; 301. oblique slot; 302. limiting groove; 4. finger pressing assembly; 400. pressing head; 401. elastic component; 402. limiting block; 403. guiding block; 5. counting device; 500. counting device main body; 501. display; 502. counting head; 6. locking plate; 600. locking groove; 601. push button; 602. first positioning groove; 603. second positioning groove; 7. holder; 700. sliding groove; 701. elastic plate; 702. positioning protrusion; 8. knob; 800. inserting block; 801. limiting wall; 802. arc-shaped protrusion; 803. second spring; 804. limiting plate.

DETAILED DESCRIPTION OF EMBODIMENTS

The present disclosure is further described in detail below with reference to accompanying drawings and specific embodiments.

As shown in FIGS. 1-11, the embodiments of the present disclosure provide a multifunctional hand grip exerciser for hand grip training, finger strength training, and arm strength training, including a main body 1 and a lever 3, the main body 1 is gun-shaped or L-shaped and includes an outer housing 100 and an elastic assembly 2, the elastic assembly 2 is disposed in the outer housing 100, and a handle portion 101 is formed on the outer housing 100. The lever is rotatably connected to the outer housing 100 of the main body 1 through a rotating shaft 300, a driving end of the lever 3 is disposed in the outer housing 100, the driving end of the lever 3 is connected to the elastic assembly 2, and the elastic assembly 2 is configured to provide resistance for the lever 3 to rotate and a restoring force for returning the lever 3 to an original position. When a user train using the multifunctional hand grip exerciser, one hand of the user holds the handle portion 101 and four fingers of the one hand of the user are placed on the lever 3 for the hand grip training.

Figure 2:
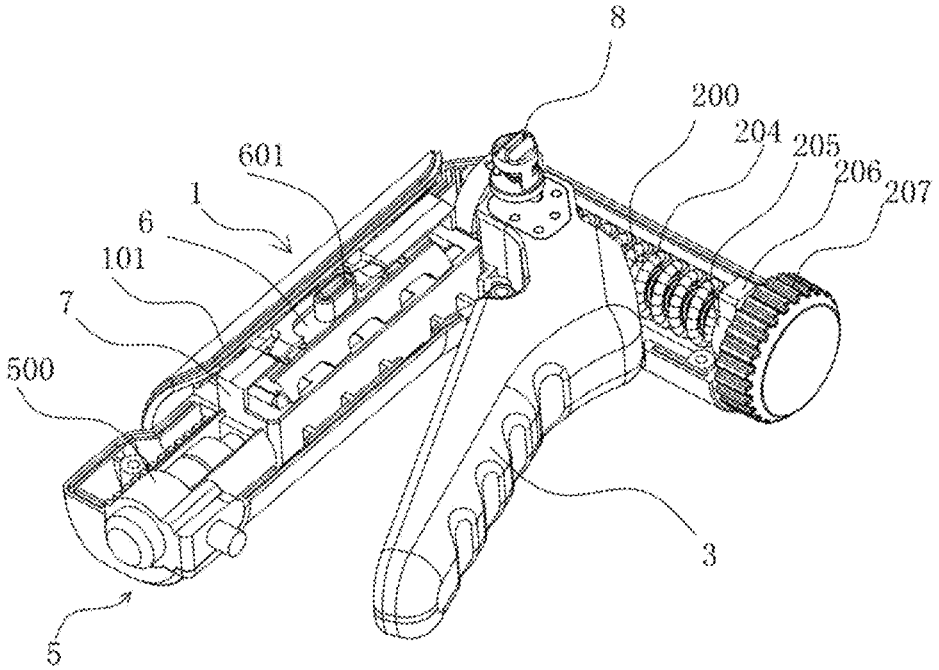
FIG. 2 is an internal structural schematic diagram of the multifunctional hand grip exerciser of the present disclosure.
Figure 4:
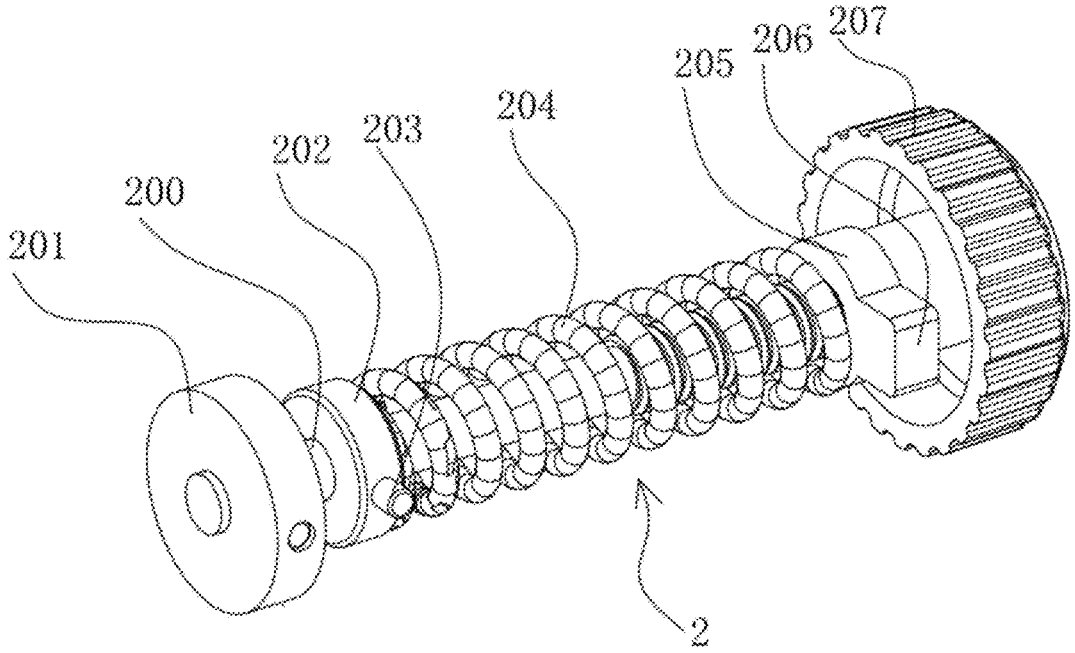
FIG. 4 is a structural schematic diagram of an elastic assembly of the multifunctional hand grip exerciser of the present disclosure.
Figure 5:
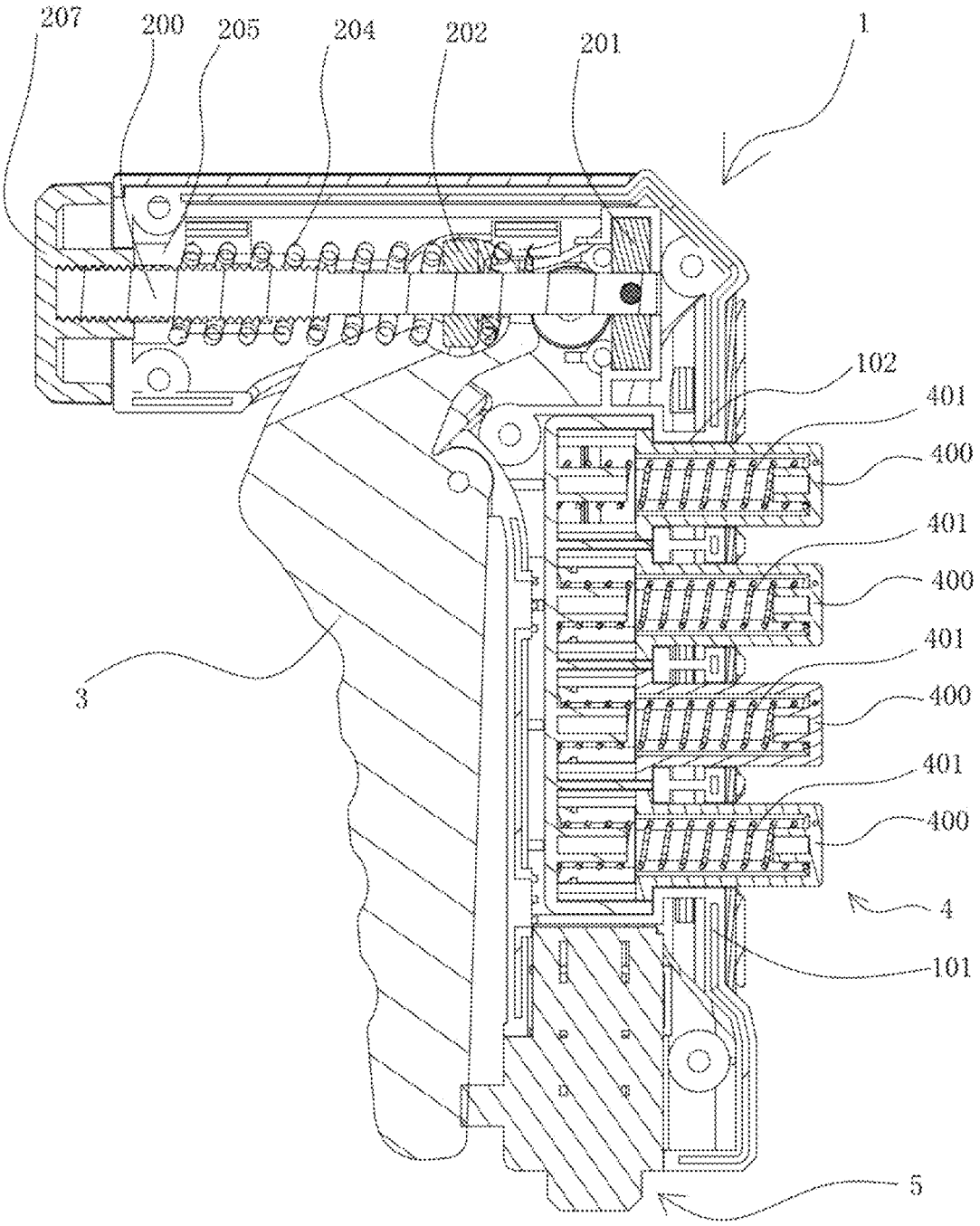
FIG. 5 is a cross-sectional schematic diagram of the multifunctional hand grip exerciser of the present disclosure.

As shown in FIGS. 2 and 4-5, in the embodiment, the elastic assembly 2 includes a guiding rod 200, the guiding rod 200 is disposed in the main body 1 and is rotatable in a circumferential direction. Specifically, a rotating disc 201 is rotatably disposed in the main body 1, the guiding rod 200 is connected to a center of the rotating disc 201 and rotates along with the rotating disc 201, a first spring 204 and a sliding component 202 are slidably sleeved on the guiding rod 200. The sliding component 202 is connected to the driving end of the lever 3, the lever 3 drives the sliding component 202 to slide on the guiding rod 200 when rotating with respect to the handle portion 101. In the embodiments, two connecting shafts 203 are connected to an outer side wall of the sliding component 202, the two connecting shafts share the same axis and protrude outward, two oblique slots 301 are defined at the driving end of the lever 3, the two connecting shafts 203 on the sliding component 202 are respectively in clearance fit with the two oblique slots 301 at the driving end of the lever 3, and when the lever 3 is pulled, the two oblique slots 301 respectively apply pushing forces to the two connecting shafts 203 to drive the sliding component 202 to slide. The guiding rod 200 includes a threaded section, an adjusting block 205 is screwed with the threaded section, the adjusting block 205 includes a radial protrusion 206 on an outer side wall thereof, the radial protrusion 206 horizontally extends outward, the radial protrusion 206 is in clearance fit with a rectangular groove 107 defined on an inner wall of the outer housing 100, in this way, a circumferential rotation of the adjusting block 205 is limited by an inner wall of the main body, when the guiding rod 200 rotates, the adjusting block 205 moves along a radial direction of the guiding rod 200 to generate displacement. A first end of the first spring 204 abuts against the sliding component 202, a second end of the first spring 204 abuts against the adjusting block 205. An adjusting base 207 is connected to an outer end of the guiding rod 200, the adjusting base 207 rotates to drive the guiding rod 200 to synchronously rotate, so that the adjusting block 205 moves in a length direction of the guiding rod 200 to generate displacement to adjust a first elastic force of the first spring 204. In this way, an elastic force of the elastic assembly 2 is adjustable, a grip force required for operating the multifunctional hand grip exerciser is also changeable, thereby meeting requirements of different users or meeting requirements for the grip force required for operating the multifunctional hand grip exerciser at different training stages.

As shown in FIGS. 1-2, in the embodiments, a counting device 5 is disposed on the handle portion 101, the counting device 5 includes a counting device main body 500 disposed in the handle portion 101. The counting device main body 500 includes a display 501 disposed on the handle portion 101, the display 501 is configured to display a count, a counting head 502 is connected to a side wall of the handle portion 101 close to the lever 3, and the counting device main body 500 counts once when the lever 3 is close to or in contact with the counting head 502. The counting device 5 enables counting of the multifunctional hand grip exerciser more convenient, which is convenient for the user to perform scientific training using the multifunctional hand grip exerciser. The counting device 5 is a counting module in the prior art, where the counting heads 502 may be counting contacts or counting sensors, etc., and counting devices in the prior art are all applicable, which is not described in detail in the embodiments.

Figure 3:
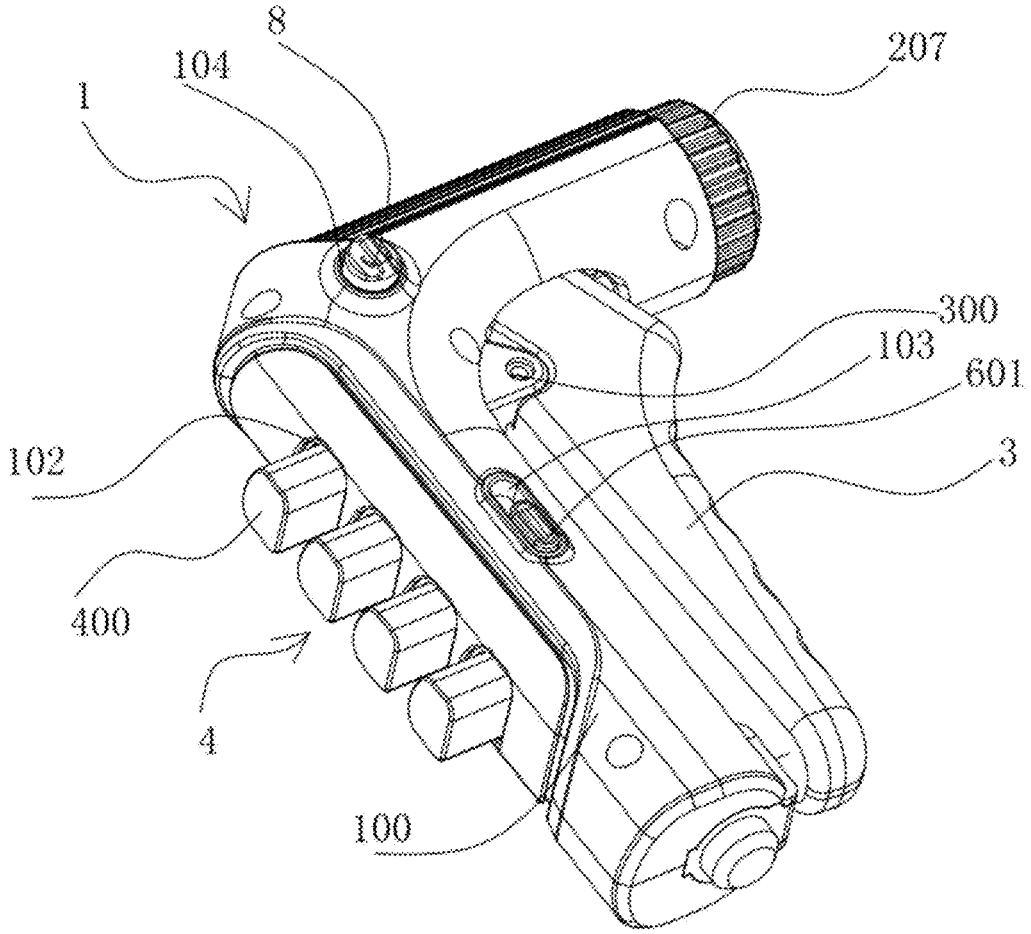
FIG. 3 is a structural schematic diagram of the multifunctional hand grip exerciser where a lever is pressed down.

As shown in FIGS. 3-4, in the embodiments, mounting cavities 102 are defined on the handle portion 101, outer ends of the mounting cavities 102 respectively penetrate through a surface of the handle portion 101, and the mounting cavities 102 are sequentially defined along a length direction of the handle portion 101. The multifunctional hand grip exerciser of the present disclosure further includes a finger pressing assembly 4, the finger pressing assembly 4 includes pressing heads 400 for pressing, the pressing heads 400 are disposed corresponding to the mounting cavities 102, the pressing heads 400 are respectively and slidably disposed in the mounting cavities 102, and free ends of the pressing heads 400 are capable of respectively extending out of or retracting into the mounting cavities 102. Elastic components 401 are respectively disposed in the mounting cavities 102 and respectively abut against the pressing heads 400, the elastic components 401 enable the free ends of the pressing heads 400 to keep in a first tendency to extend out of the mounting cavities 102. In the embodiments, the pressing heads 400 are sequentially disposed along the length direction of the handle portion 101. Specifically, four pressing heads 400 are provided for corresponding to four fingers of the user excluding a thumb, when the user performs the finger strength training, the user applies force to each of the four pressing heads 400 with the respective fingers, and the four pressing heads 400 are capable of automatically returning to original positions under elastic forces of the elastic components 401, the elastic components 401 in the present disclosure are springs.

In the embodiments, the finger pressing assembly 4 is disposed on the handle portion 101 of the main body 1, and the pressing heads 400 of the finger pressing assembly 4 are provided for users to perform finger strength training, finger relaxation training, or finger recovery training, so as to meet the requirements of different users, especially, after a period of grip training for hands, the hands may become fatigued or painful, and the users may use the finger pressing assembly 4 to perform relaxation or recovery exercises on their fingers to alleviate fatigue or pain, the multifunctional hand grip exerciser is diversified in functions and is capable of meeting the requirements of different users.

Figure 6:
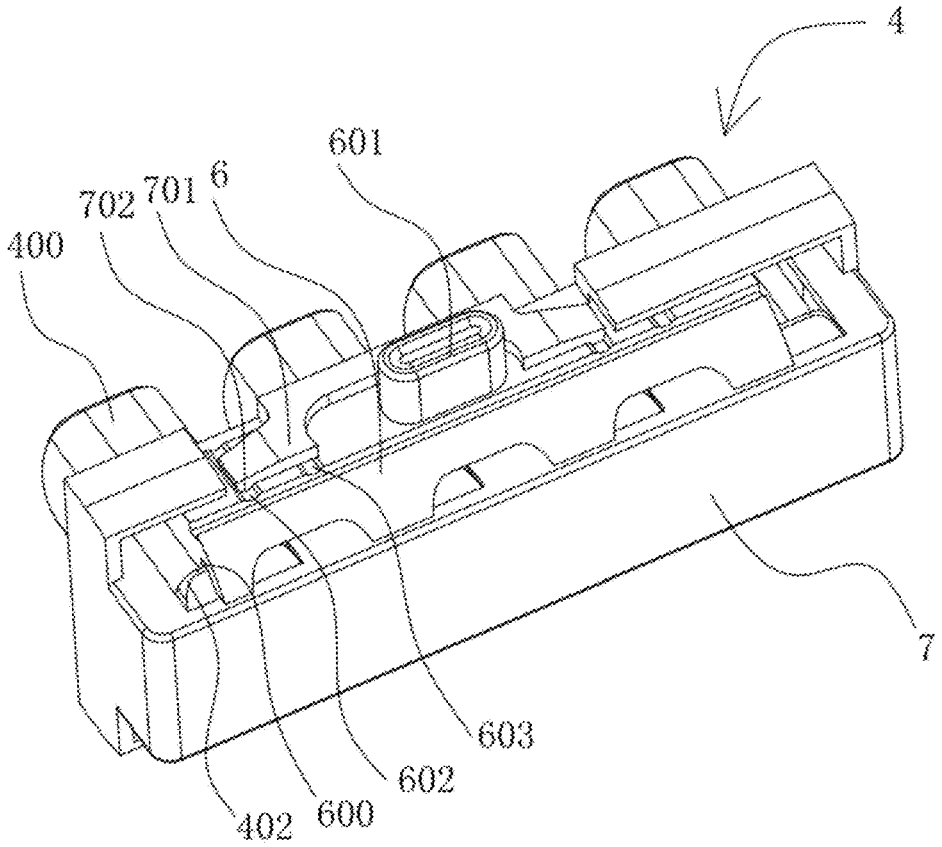
FIG. 6 is a structural schematic diagram of a finger pressing assembly of the multifunctional hand grip exerciser of the present disclosure.
Figure 7:
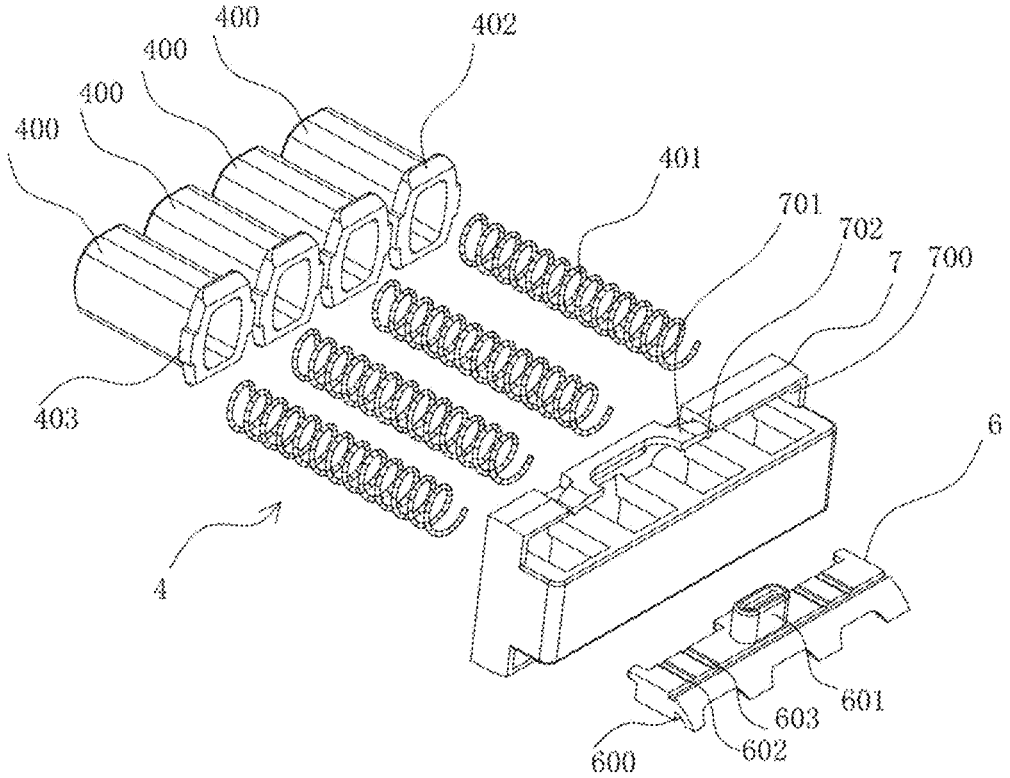
FIG. 7 is an assembly schematic diagram of the finger pressing assembly of the multifunctional hand grip exerciser of the present disclosure.
Figure 8:
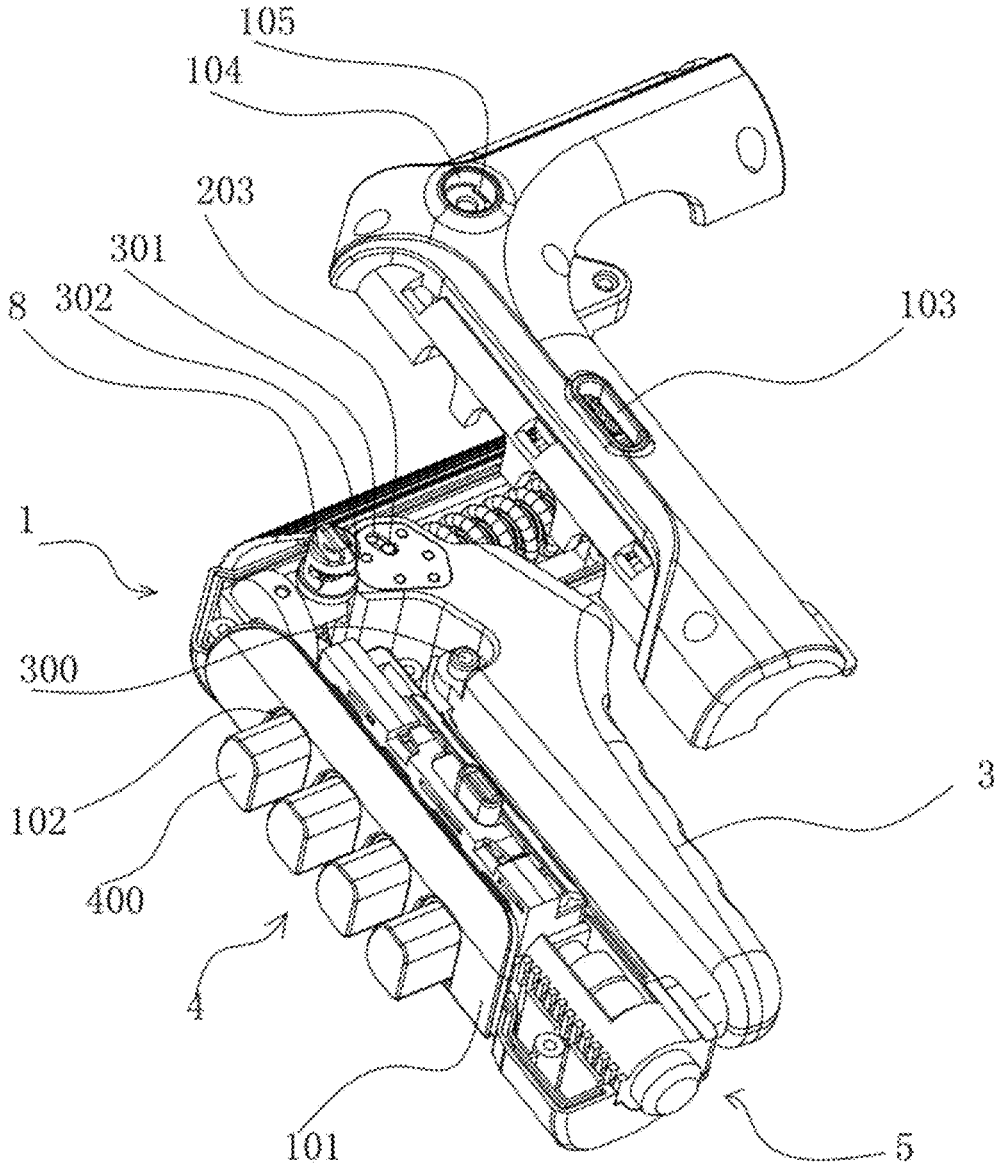
FIG. 8 is a schematic diagram of an assembly structure of the multifunctional hand grip exerciser of the present disclosure.
Figure 9:
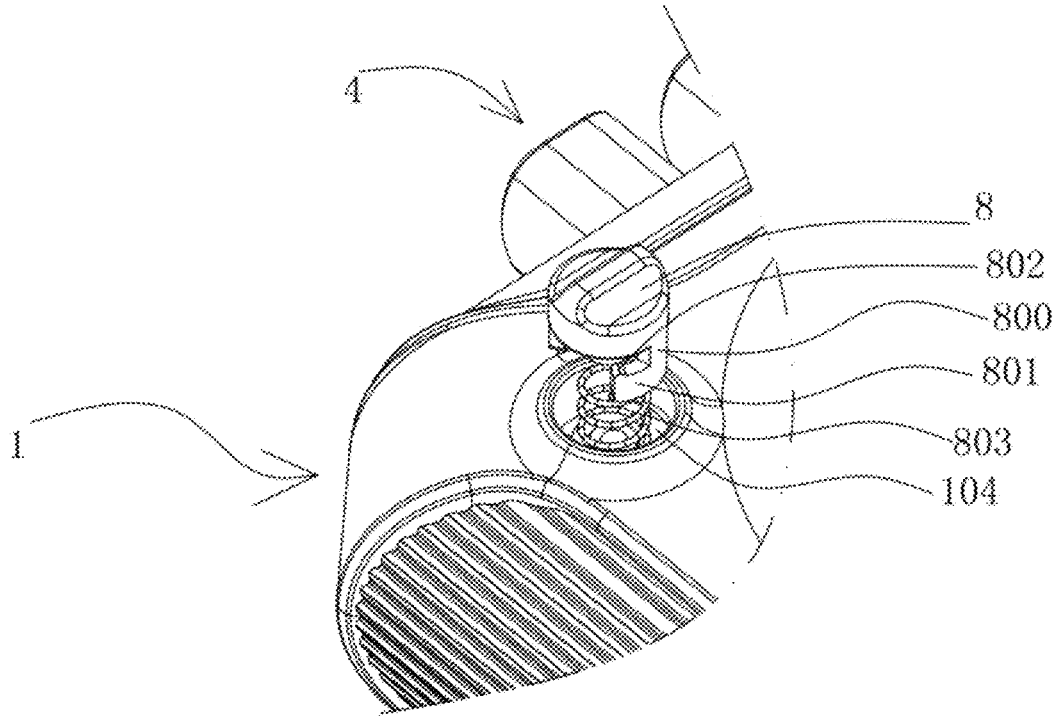
FIG. 9 is a schematic diagram of a connection structure of a knob of the multifunctional hand grip exerciser of the present disclosure.
Figure 10:
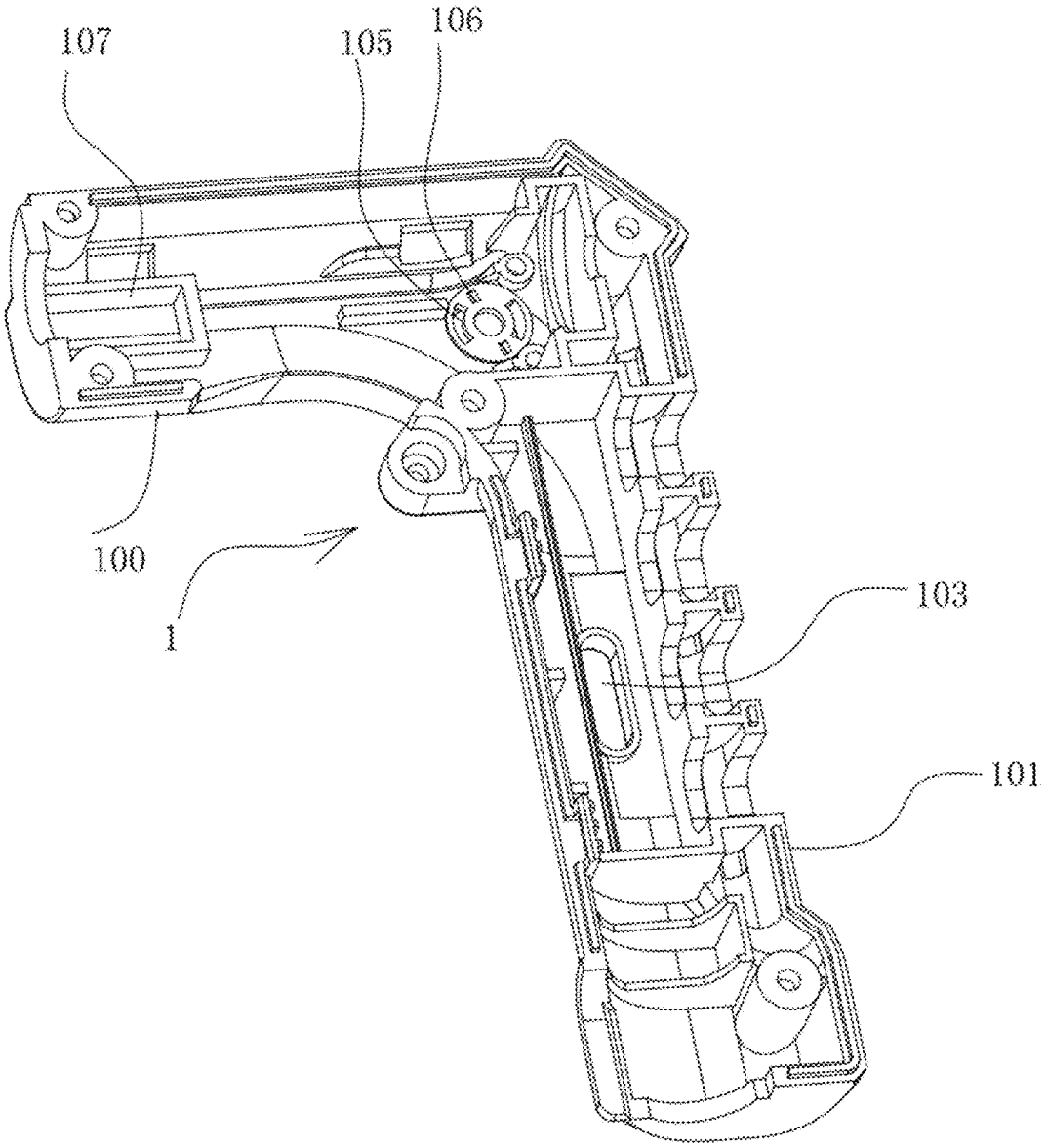
FIG. 10 is an internal structural schematic diagram of an outer housing of the multifunctional hand grip exerciser of the present disclosure.
Figure 11:
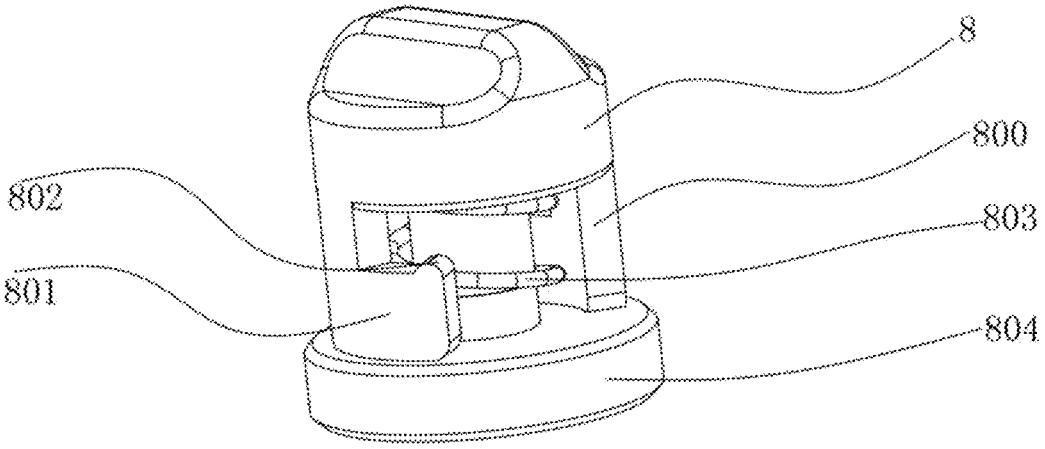
FIG. 11 is a structural schematic diagram of the knob of the multifunctional hand grip exerciser of the present disclosure.

As shown in FIGS. 6-7, in the embodiments, the multifunctional hand grip exerciser includes a locking assembly, the locking assembly is connected to the handle portion 101 and is configured to enable the pressing heads 400 to be in a locked state or an unlocked state. When the pressing heads 400 are in the locked state, the free ends of the pressing heads 400 retract and are kept in the mounting cavities 102. When the pressing heads 400 are in the unlocked state, the free ends of the pressing heads 400 extend out of the mounting cavities 102. When the users train the hands and strengthen forearm muscles using the lever 3 and the handle portion 101, the pressing heads 400 of the finger pressing assembly 4 are retracted into the handle portion 101 and are locked through the locking assembly, so that the finger pressing assembly 4 on the handle portion 101 does not affect the grip strength training or forearm muscle strength training, which is very convenient for use.

In the embodiments, the locking assembly includes a locking plate 6 and a push button 601, the push button 601 is connected to the locking plate 6. Each of the pressing heads 400 includes a limiting block 402 connected to a first outer side wall of an inner end thereof, and each limiting block 402 horizontally extends outward. The locking plate 6 is slidably disposed in the handle portion 101 along the length direction of the handle portion 101, the locking plate 6 includes locking grooves 600, each of the locking grooves 600 is configured to clamp a corresponding limiting block 402 when the pressing heads 400 retract into the mounting cavities 102. A push button hole 103 extending along the length direction of the handle portion 101 is defined on the outer housing 100, the push button 61 is in clearance fit with the push button hole 103 and is exposed out of the push button hole 103. When the pressing heads 400 are locked through the locking assembly, the pressing heads 400 are respectively retracted into the mounting cavities 102 against elastic forces of the elastic components 401, and then the locking plate 6 is moved by pushing the push button 601, so that each of the locking grooves 600 of the locking plate 6 is clamped with the corresponding limiting block 402 at a corresponding inner end of a corresponding one of the pressing heads 400, so that the pressing heads 400 are respectively locked in the mounting cavities 102; on the contrary, when the push button 601 is pushed in an opposite direction to move the locking plate 6 in the opposite direction, so that each of the locking grooves 600 of the lock plate 6 is separated from the corresponding limiting block 402 at the corresponding inner end of the corresponding one of the pressing heads 400, the free ends of the pressing heads 400 automatically extend out of the mounting cavities 102 under the elastic forces of the elastic components 401, and at this time, the users may perform finger pressing training through the pressing heads 400.

As shown in FIG. 7, in one embodiment of the present disclosure, a holder 7 is further disposed in the handle portion 101, the holder 7 is disposed along the length direction of the handle portion 101, the mounting cavities 102 are defined on the holder 7 along a length direction of the holder 7, the holder 7 includes a sliding groove 700 at one side thereof, the sliding groove 700 is communicated with the mounting cavities 102, and the locking plate 6 is slidably disposed in the sliding groove 700. At least one positioning protrusion 702 is disposed on an inner side wall of the holder 7, the at least one positioning protrusion 702 extends into the sliding groove 700, at least two positioning grooves are defined on an outer side wall of the locking plate 6, the at least two positioning grooves are elastically clamped with the at least one positioning protrusion 702, when the locking plate 6 slides along a length direction of the sliding groove 700, the at least one positioning protrusion 702 is switched between the at least two positioning grooves, so as to lock or unlock the locking plate 6. In the embodiment, two openings are defined on a top portion of the holder 7, an elastic plate 701 is disposed between the two openings, two positioning protrusions 702 are provided and are respectively disposed at two bottom end portions of the elastic plate 701. Four positioning grooves are respectively disposed at two opposite sides of a top portion of the locking plate 6, and the four positioning grooves includes two first positioning grooves 602 and two second positioning grooves 603, each of the two first positioning grooves 602 and a corresponding one of two second positioning grooves 603 are distributed at intervals. When the two positioning protrusions 702 of the locking plate 6 are respectively located in the two first positioning grooves 602, the pressing heads 400 are unlocked; when the two positioning protrusions 702 of the locking plate 6 are respectively located in the two second positioning grooves 603, the pressing heads 400 are locked. Or, when the two positioning protrusions 702 of the locking plate 6 are respectively located in the two first positioning grooves 602, the pressing heads 400 are locked; when the two positioning protrusions 702 of the locking plate 6 are respectively located in the two second positioning grooves 603, the pressing heads 400 are unlocked. The at least two positioning grooves are matched and clamped with the at least one positioning protrusion 702, on the one hand, states of the pressing heads 400 including the unlocking state and the locking state are determined, on the other hand, accidental sliding of the locking plate 6 is prevented.

In the embodiments, in order to ensure that the pressing heads 400 operate smoothly without deviation or tilting, guiding grooves (not shown in the drawings) are defined on inner walls of each of the mounting cavities, each guiding grooves extend along a length direction of a corresponding one of the mounting cavities 102, each of the pressing heads 400 further includes guiding blocks 403 respectively disposed on a second outer side wall and a third outer wall of the inner end thereof, and the guiding blocks 403 are respectively in clearance fit with the guiding grooves.

As shown in FIGS. 8-11, in the embodiments, a locking mechanism is disposed on the main body 1, the locking mechanism is configured to lock the lever 3 when the lever 3 is pressed down to keep the lever in a pressed-down state. Specifically, a knob groove 104 is defined on the main body 1, a knob 8 is rotatably disposed in the knob groove 104, and the knob 8 moves in an axial direction when rotating to generate displacement. A limiting plate 804 is disposed in the main body 1 and is connected to an inner end of the knob 8, a limiting groove 302 for matching and clamping with the limiting plate 804 is defined on an outer side wall of the driving end of the lever 3. A second spring 803 is disposed in the knob groove 104, a first end of the second spring 803 abuts against an inner bottom wall of the knob groove 104, a second end of the second spring 803 abuts against the knob 8, the second spring 803 is configured to apply a second elastic force to the knob 8 to enable the limiting plate 804 to always have a second tendency to move away from the limiting groove 302. When the lever 3 is pressed down, the knob 8 is rotated to clamp the limiting plate 804 with the limiting groove 302, and the lever 3 is locked to keep in the pressed-down state. It is not difficult to understand that the knob groove 104 coincides with an axis of the knob 8, the knob 8 is also capable of being screwed into the knob groove 104, when the knob 8 rotates, the knob 8 axially moves with respect to the knob groove 104.

Specifically, in the embodiments, two insertion holes 105 are circumferentially defined on an inner bottom wall of the knob groove 104, the knob 8 includes two inserting blocks 800, the two inserting blocks 800 are in clearance fit with the insertion holes 105, limiting walls 801 are connected to inner ends of the two inserting blocks 800, the limiting walls 801 extend in a circumferential direction of the knob groove 104, the limiting walls 801 abut against an outer bottom wall of the knob groove 104 to limit the knob 8 in the knob groove 104. Accommodating grooves 106 are recessed inward from the outer bottom wall of the knob groove 104 corresponding to the limiting walls 801, arc-shaped protrusions 802 respectively protrude outward from the limiting walls 801, the arc-shaped protrusions 802 are respectively fit in the accommodating grooves 802 and are movable. When the lever 3 is pressed down and the knob 8 is rotated, the arc-shaped protrusions 802 on the limiting walls 801 are respectively separated from the accommodating grooves 106 to enable the limiting plate 804 to move in a direction close to the limiting groove 302 and clamp in the limiting groove 302. Forms or structures of the locking mechanism are various, for example, a U-shaped ring is provided to lock the lever 3, that is, the U-shaped ring is connected to the handle portion 101, and the lever 3 is capable of being fixed in the U-shaped ring when being pressed down. Alternatively, the locking mechanism is a fastener or an interlocking component, and the lever 3 is capable of being connected to the handle portion 101 through the fastener or the interlocking component when being pressed down, so that the lever 3 is kept in the locked state.

The above are only specific embodiments of the present disclosure, but a protection scope of the present disclosure is not limited thereto, and any changes or substitutions that can be easily conceived of by those who skilled in the art within a technical scope disclosed by the present disclosure shall fall within the protection scope of the present disclosure. Therefore, the protection scope of the present disclosure shall be subject to a protection scope of the claims.

What is claimed is:

1. A multifunctional hand grip exerciser, comprising:
a main body;
a lever; and
a finger pressing assembly;
wherein the main body comprises a handle portion, an elastic assembly is disposed in the main body, mounting cavities are defined on the handle portion, and outer ends of the mounting cavities respectively penetrate through a surface of the handle portion;
the lever is rotatably connected to the main body, a driving end of the lever is connected to the elastic assembly, and the elastic assembly is configured to provide resistance for the lever to rotate;
the finger pressing assembly comprises pressing heads for pressing, the pressing heads are disposed corresponding to the mounting cavities, the pressing heads are respectively and slidably disposed in the mounting cavities, and free ends of the pressing heads are capable of respectively extending out of or retracting into the mounting cavities;
elastic components are respectively disposed in the mounting cavities and respectively abut against the pressing heads, The elastic components enable the free ends of the pressing heads to keep in a first tendency to extend out of the mounting cavities;
the multifunctional hand grip exerciser comprises a locking assembly, the locking assembly is connected to the handle portion and is configured to enable the pressing heads to be in a locked state or an unlocked state;
when the pressing heads are in the locked state, the free ends of the pressing heads retract and are kept in the mounting cavities; and
when the pressing heads are in the unlocked state, the free ends of the pressing heads extend out of the mounting cavities.

2. The multifunctional hand grip exerciser according to claim 1, wherein the pressing heads are sequentially disposed in a length direction of the handle portion, each of the pressing heads comprises a limiting block connected to a first outer side wall of an inner end thereof, and each limiting block horizontally extends outward;
a locking plate is slidably disposed in the handle portion along the length direction of the handle portion, the locking plate comprises locking grooves, each of the locking grooves is configured to clamp a corresponding limiting block when the pressing heads retract into the mounting cavities; and a push button is connected to locking plate and is exposed out of the surface of the handle portion.

3. The multifunctional hand grip exerciser according to claim 2, wherein a holder is further disposed in the handle portion, the mounting cavities are defined on the holder along a length direction of the holder, the holder comprises a sliding groove at one side thereof, the sliding groove is communicated with the mounting cavities, and the locking plate is slidably disposed in the sliding groove; and at least one positioning protrusion is disposed on an inner side wall of the holder, the at least one positioning protrusion extends into the sliding groove, at least two positioning grooves are defined on an outer side wall of the locking plate, the at least two positioning grooves are elastically clamped with the at least one positioning protrusion, when the locking plate slides along a length direction of the sliding groove, the at least one positioning protrusion is switched between the at least two positioning grooves, so as to lock or unlock the locking plate.

4. The multifunctional hand grip exerciser according to claim 3, wherein guiding grooves are defined on inner walls of each of the mounting cavities, each guiding grooves extend along a length direction of a corresponding one of the mounting cavities, each of the pressing heads further comprises guiding blocks respectively disposed on a second outer side wall and a third outer wall of the inner end thereof, and the guiding blocks are respectively in clearance fit with the guiding grooves.

5. The multifunctional hand grip exerciser according to claim 1, wherein the multifunctional hand grip exerciser further comprises a counting device, the counting device comprises a counting device main body disposed in the handle portion; and the counting device main body comprises a display disposed on the handle portion, the display is configured to display a count, a counting head is connected to a side wall of the handle portion close to the lever, and the counting device main body counts once when the lever is close to or in contact with the counting head.

6. The multifunctional hand grip exerciser according to claim 1, wherein the elastic assembly comprises a guiding rod, the guiding rod is disposed in the main body and is rotatable in a circumferential direction, a first spring and a sliding component are slidably sleeved on the guiding rod;

the sliding component is connected to the driving end of the lever, the lever drives the sliding component to slide on the guiding rod when rotating with respect to the handle portion;

an adjusting block is screwed with the guiding rod, and a circumferential rotation of the adjusting block is limited by an inner wall of the main body;

a first end of the first spring abuts against the sliding component, a second end of the first spring abuts against the adjusting block; and an adjusting base is connected to an outer end of the guiding rod, the adjusting base rotates to drive the guiding rod to simultaneously rotate, so that the adjusting block moves in a length direction of the guiding rod to adjust a first elastic force of the first spring.

7. The multifunctional hand grip exerciser according to claim 1, wherein a locking mechanism is disposed on the main body, the locking mechanism is configured to lock the lever when the lever is pressed down to keep the lever in a pressed-down state.

8. The multifunctional hand grip exerciser according to claim 7, wherein a knob groove is defined on the main body, a knob is rotatably disposed in the knob groove, and the knob moves in an axial direction when rotating;

a limiting plate is disposed in the main body and is connected to an inner end of the knob, a limiting groove for matching and clamping with the limiting plate is defined on an outer side wall of a driving end of the lever;

a second spring is disposed in the knob groove, a first end of the second spring abuts against an inner bottom wall of the knob groove, a second end of the second spring abuts against the knob, the second spring is configured to apply a second elastic force to the knob to enable the limiting plate to always have a second tendency to move away from the limiting groove; and when the lever is pressed down, the knob is rotated to clamp the limiting plate with the limiting groove, and the lever is locked to keep in the pressed-down state.

9. The multifunctional hand grip exerciser according to claim 8, wherein two insertion holes are circumferentially defined on an inner bottom wall of the knob groove, the knob comprises two inserting blocks, the two inserting blocks are in clearance fit with the insertion holes, limiting walls are connected to inner ends of the two inserting blocks, the limiting walls extend in a circumferential direction of the knob groove, the limiting walls abut against an outer bottom wall of the knob groove to limit the knob in the knob groove;

accommodating grooves are recessed inward from the outer bottom wall of the knob groove corresponding to the limiting walls, arc-shaped protrusions respectively protrude outward from the limiting walls, the arc-shaped protrusions are respectively fit in the accommodating grooves and are movable; and when the lever is pressed down and the knob is rotated, the arc-shaped protrusions on the limiting walls are respectively separated from the accommodating grooves to enable the limiting plate to move in a direction close to the limiting groove and clamp in the limiting groove.

10. A multifunctional hand grip exerciser, comprising:

a main body;

a lever; and a finger pressing assembly;

wherein the main body comprises a handle portion, an elastic assembly is disposed in the main body, mounting cavities are defined on the handle portion, and outer ends of the mounting cavities respectively penetrate through a surface of the handle portion;

the lever is rotatably connected to the main body, a driving end of the lever is connected to the elastic assembly, and the elastic assembly is configured to provide resistance for the lever to rotate;

the finger pressing assembly comprises pressing heads for pressing, the pressing heads are disposed corresponding to the mounting cavities, the pressing heads are respectively and slidably disposed in the mounting cavities, and free ends of the pressing heads are capable of respectively extending out of or retracting into the mounting cavities;

elastic components are respectively disposed in the mounting cavities and respectively abut against the pressing heads, the elastic components enable the free ends of the pressing heads to keep in a first tendency to extend out of the mounting cavities;

the elastic assembly comprises a guiding rod, the guiding rod is disposed in the main body and is rotatable in a circumferential direction, a first spring and a sliding component are slidably sleeved on the guiding rod;

the sliding component is connected to the driving end of the lever, the lever drives the sliding component to slide on the guiding rod when rotating with respect to the handle portion;

an adjusting block is screwed with the guiding rod, and a circumferential rotation of the adjusting block is limited by an inner wall of the main body;

a first end of the first spring abuts against the sliding component, a second end of the first spring abuts against the adjusting block; and an adjusting base is connected to an outer end of the guiding rod, the adjusting base rotates to drive the guiding rod to simultaneously rotate, so that the adjusting block moves in a length direction of the guiding rod to adjust a first elastic force of the first spring.

11. A multifunctional hand grip exerciser, comprising:

a main body;

a lever; and a finger pressing assembly;

wherein the main body comprises a handle portion, an elastic assembly is disposed in the main body, mounting cavities are defined on the handle portion, and outer ends of the mounting cavities respectively penetrate through a surface of the handle portion;

the lever is rotatably connected to the main body, a driving end of the lever is connected to the elastic assembly, and the elastic assembly is configured to provide resistance for the lever to rotate;

the finger pressing assembly comprises pressing heads for pressing, the pressing heads are disposed corresponding to the mounting cavities, the pressing heads are respectively and slidably disposed in the mounting cavities, and free ends of the pressing heads are capable of respectively extending out of or retracting into the mounting cavities; and a locking mechanism is disposed on the main body, and the locking mechanism is configured to lock the lever when the lever is pressed down to keep the lever in a pressed-down state.

* * * * *